United States Patent [19]

Suska

[11] Patent Number: 4,475,266

[45] Date of Patent: Oct. 9, 1984

[54] NON-HANDED TWO KNUCKLE HINGE

[75] Inventor: Charles R. Suska, Roxbury, Conn.

[73] Assignee: The Stanley Works, New Britain, Conn.

[21] Appl. No.: 42,020

[22] Filed: May 24, 1979

[51] Int. Cl.[3] ..... E05D 5/12; E05D 11/03

[52] U.S. Cl. ..... 16/273; 16/380; 16/381; 16/386

[58] Field of Search ..... 16/134, 136, 168, 169, 16/170, 176

[56] References Cited

U.S. PATENT DOCUMENTS

| | | | |
|---|---|---|---|
| 36,976 | 11/1862 | Acker | 16/189 |
| 114,813 | 5/1871 | Hawkes | 16/189 |
| 133,699 | 12/1872 | Crawford | 16/189 |
| 279,857 | 6/1883 | Campbell | 16/168 X |
| 793,703 | 7/1905 | Williams | 16/136 X |
| 992,182 | 5/1911 | Foss | 16/134 |
| 1,563,869 | 12/1925 | Larson | 16/134 |
| 2,154,860 | 4/1939 | Morse | 16/169 |
| 2,611,921 | 9/1952 | Weidelstam | 16/129 |
| 2,641,794 | 6/1953 | Raskin | 16/134 |
| 2,817,871 | 12/1957 | Ferry | 16/169 |
| 3,390,419 | 7/1968 | Foltz | 16/168 X |
| 3,401,422 | 9/1968 | Ventura | 16/54 |
| 3,499,183 | 3/1970 | Parsons | 16/136 |
| 3,903,567 | 9/1975 | Suska | 16/136 X |
| 3,921,225 | 11/1975 | Suska | 16/136 |
| 3,999,246 | 12/1976 | Suska | 16/136 |
| 4,068,344 | 1/1978 | Okabe | 16/54 |

*Primary Examiner*—Wm. Carter Reynolds

*Attorney, Agent, or Firm*—Brumbaugh, Graves, Donohue & Raymond

[57] ABSTRACT

A non-handed two knuckle hinge comprises a pair of axially aligned hinge knuckles formed respectively on adjacent edges of two hinge leaves, and a pintle extending through the bore of one hinge knuckle into the bore of the second hinge knuckle. The pintle is secured in the bore of the second hinge knuckle, and the first hinge knuckle is pivotable about the pintle. The hinge includes a first vertical thrust bearing formed between the hinge knuckles for acting as a thrust bearing when the door is attached to the hinge leaf associated with the upper hinge knuckle, and a second vertical load bearing formed between the pintle head and the first hinge knuckle for acting as a thrust bearing when the door is attached instead to the hinge leaf associated with the lower hinge knuckle. Lateral bearing surfaces are provided in the first hinge knuckle for supporting the pintle at least in the vicinity of each end of the bore of the first hinge knuckle. The hinge may be used interchangeably in left-handed and right-handed door installations and inverted in either type of installation without affecting the operation of the hinge.

16 Claims, 2 Drawing Figures

NON-HANDED TWO KNUCKLE HINGE

BACKGROUND OF THE INVENTION

The handedness of a particular door installation is determined by the direction in which the door pivots when opened. If a door in the closed position is pivoted counterclockwise to open it, the door installation is considered to be left-handed. On the other hand, a door in a right-handed door installation is pivoted clockwise when opened. When hung from a jamb, a left-handed door would be attached using a left-handed hinge, and a right-handed door a right-handed hinge, unless a non-handed hinge is employed.

In the case of a two-knuckle hinge, in which a pair of hinge leaves each have one hinge knuckle formed on the adjacent edges of two hinge leaves, with one leaf attached to the jamb and the other leaf attached to the door, the hinge leaf associated with the lower hinge-knuckle must be attached to the jamb so that it will support the rest of the hinge assembly. The interface of the lower hinge knuckle and the hinge knuckle on the other hinge leaf, which rests on top of the knuckle attached to the jamb, form a vertical load or thrust bearing to carry the door and provide a surface about which the upper hinge knuckle and leaf may pivot. If one were to attempt to reverse the function of the hinge, however, that is, if a right-handed two-knuckle hinge, for instance, were to be used on a left-handed door installation, the door would have to be hung from the hinge leaf associated with the lower hinge knuckle, and the weight of the door would tend to separate the hinge knuckles rendering the thrust bearing ineffective.

The fact that left or right-handed two-knuckle hinges are not interchangeable is a general marketing drawback, and a non-handed two-knuckle hinge would be preferred. One such hinge has been developed by Charles R. Suska, the inventor herein, and is described in commonly owned U.S. Pat. No. 4,351,085. A two-knuckle non-handed spring hinge is shown and described which has a pair of vertical bearings, one between the adjacent hinge knuckles, and the other located inside the bore of the other hinge knuckle, which pivots about the pintle. A portion of the other bearing is formed on the pintle. Thus, one of the two bearings will always be employed to support the door, depending upon whether the hinge is used in a right-handed or left-handed installation.

SUMMARY OF THE INVENTION

To benefit from the advantages that non-handed hinges, i.e., hinges which can be used interchangeably in left-handed and right-handed door installations, have over right or left-handed only hinges, there is provided, in accordance with the present invention, another type of two-knuckle hinge which may be attached to the door and jamb interchangeably in either a right-handed or a left-handed installation. The hinge includes a pair of axially aligned hinge knuckles formed respectively on adjacent edges of two hinge leaves, and a pintle extending through the bore of the first hinge knuckle and into the bore of the second hinge knuckle. The first hinge knuckle and hinge leaf are pivotable about the pintle, whereas the pintle is secured in the second hinge knuckle by, for example, a set screw or a cooperating threaded portion on the pintle and a fixed threaded bushing within the bore, which also fixes the axial position of the pintle in the second hinge knuckle. A first bearing is provided at the adjacent edges of the hinge knuckles for acting as a thrust bearing when the door is attached to the hinge leaf associated with the upper hinge knuckle. A second bearing between the pintle head and the first hinge knuckle acts as a thrust bearing when the door is attached to the lower of the two hinge leaves. Therefore, the hinge may be used interchangeably in left-handed and right-handed door installations, and inverted in either type of installation without affecting the operation of the hinge.

By this construction, if the leaf formed with the upper hinge knuckle is attached to a door in, for example, a conventional right-handed door installation, the bearing at the interface of the upper and lower hinge knuckles will support the vertical load. In a left-handed door installation, however, where the leaf formed on the upper hinge knuckle is attached to the jamb, the head on the pintle engages a bearing surface in the first hinge knuckle to form another bearing to support the vertical load and prevent separation of the hinge knuckles.

Each of the vertical load bearings may be provided with anti-friction elements to reduce the torque required to open and close a door hung from the jamb using the new and improved non-handed hinge, thereby increasing the life expectancy of the hinge.

In one embodiment of the invention, the pintle has an annular groove formed near its end, and is retained in the second hinge knuckle by a set screw in the second knuckle engaging the groove. The pin is free to rotate in the first knuckle on two bearing bushings disposed in the bore of the first knuckle, preferably made of plastic, one facing the second hinge knuckle and the other facing the pintle head. The pintle and two bushings are permanently retained in the first knuckle by another annular groove in the pin and a retaining ring in the groove. A thrust bearing washer is also captured between the retaining ring and the facing surface of the adjacent bearing bushing. The retaining ring and thrust washer are concealed from view in the assembled hinge by a counterbored recess in the second hinge knuckle. A second thrust bearing, for opposite direction loading, is provided by the second bearing bushing and the pintle head.

In another embodiment of the invention, the end of the pintle has threads formed thereon which engage cooperating threads in the bore of the second hinge knuckle. The pin is free to rotate relative to the first hinge knuckle on two anti-friction bearing bushings, similar to those described above in connection with the previous embodiment, in the first knuckle. The adjoining face of the second hinge knuckle may be improved as a thrust bearing surface by placing a washer, flange eyelet, or bushing in the second knuckle to bear against the bushing in the first hinge knuckle. The second knuckle may also be drilled or tapped to receive a set screw which secures the pin, once screwed in, from inadvertent rotation. The cylindrical body portions of the two bushings provide lateral load bearings journals for the pintle.

BRIEF DESCRIPTION OF THE DRAWINGS

For a better understanding of the invention, reference is made to the following description of two exemplary embodiments, taken in conjunction with the figures of the accompanying drawings, in which.

DETAILED DESCRIPTION OF THE PREFERRED EMBODIMENTS

Figure 1:
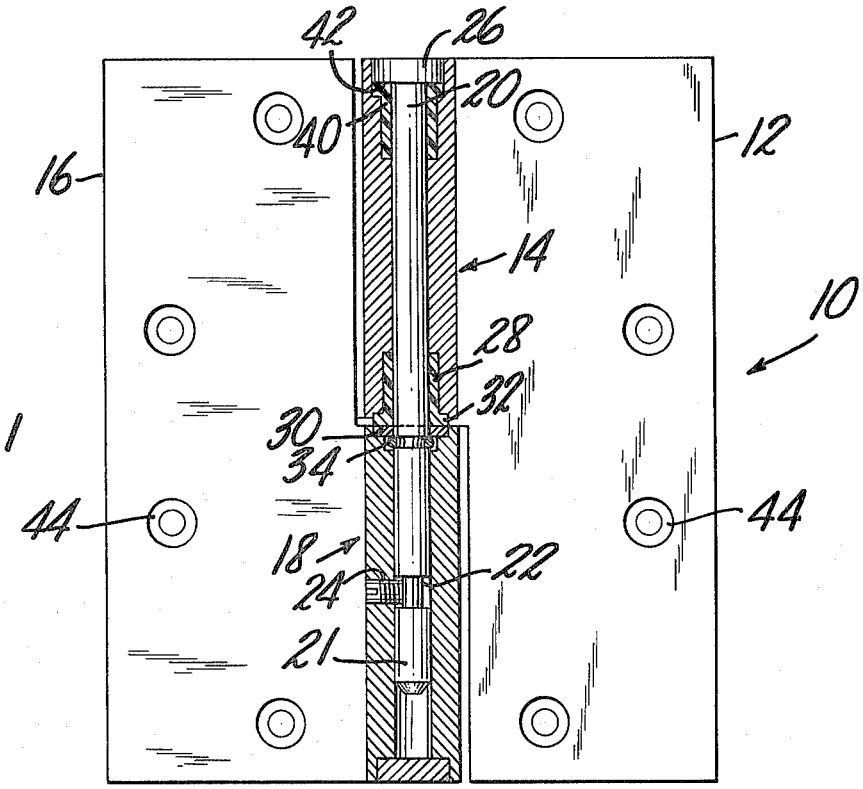
FIG. 1 is an elevational view, partially in section, of one embodiment of a non-handed two-knuckle hinge according to the present invention.

Referring to FIG. 1, a hinge 10 embodying the present invention is shown. The hinge 10 comprises a first hinge leaf 12 and first hinge knuckle 14, a second hinge leaf 16 with a second hinge knuckle 18, and a pintle 20. The respective hinge leaves 12 and 16 are provided with a series of counter-sunk mounting holes 44 adapted to receive screws, the openings 44 thereby providing attachment means for leaves.

The pintle 20, about which the first hinge knuckle 12 pivots, extends through the axially aligned bores of the first and second hinge knuckles, 14 and 18, and is secured in the second hinge knuckle 18. The pintle 20 also has a recess 22 formed near the inserting end 21 thereof, and is held in the second hinge knuckle 18 in a non-rotating manner by a set screw 24 in the second hinge knuckle 18, the hinge knuckle 18 having been drilled and tapped to receive the set screw 24. The screw 24 not only anchors the pintle 20 against rotation in the second hinge knuckle 18, but also prevents axial movement thereof. The pintle also includes a pintle head 26 of enlarged annular cross section on the end opposite the inserting end 21.

To enable free pivoting of the hinge leaves 12 and 16, both ends of the first hinge knuckle 14 are counterbored to receive bushings 28 and 40, which are made from an anti-friction material such as plastic, e.g. Stanite or Delrin AF, and circumscribe the pintle 20. A washer 30, which may be metal or plastic, is provided to interface with the end surface of the bushing 28.

The bushing 28 is essentially a tubular member having at its lower end a radially outward extending flange 32, which bears against the washer 30 and thus provides a smooth bearing surface between the two hinge knuckles 14 and 18. Besides providing a thrust bearing surface for the pintle 20 when a door is hung from the leaf 12, the bushing 28 also provides a first lateral bearing surface in the pivoting hinge knuckle 12 for the pintle 20.

The second bushing 40 also has a radially outwardly extending flange 42, facing the pintle head 26, and the first hinge knuckle 14 is counterbored to receive both the second bushing 40 and the pintle head 26. A transverse annular shoulder portion in the counterbore acts as a seat for the flange 42. A second bearing surface is therefore formed between the flange portion 42 of the second bearing 40, which flange 42 forms a transverse annular shoulder portion for the pintle head 26, and the pintle head 26. Thus, in a right-handed door installation, where the lower hinge leaf 16, for example, is attached to the door, the pintle head 26 would prevent separation of the two hinge leaves 12 and 16, and provide a load bearing surface over which the hinge knuckle 14 and hinge leaf 12 may rotate. This second bushing 40 also provides a second lateral bearing surface in the pivoting hinge knuckle 14 for the pintle 20.

As also shown in FIG. 1, the entire assembly which is intended to be retained in the first hinge knuckle 14, consisting of the pintle 20, and the first and second bushings 28 and 40, plus the washer 30 intended to be received in the second hinge knuckle 18, may be permanently held in the assembled configuration by providing an annular groove in the pintle 20, adjacent the washer 30, and attaching a retaining ring 34. This will facilitate the assembly and disassembly of the hinge when hanging the door, since the hinge will separate into only two components.

Figure 2:
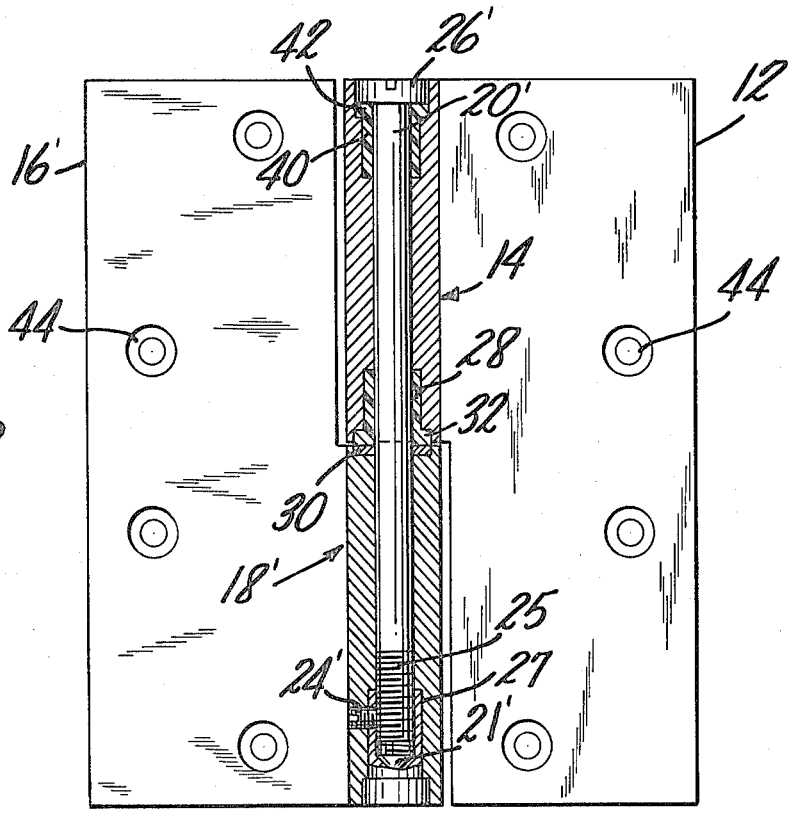
FIG. 2 is an elevational view of another embodiment of a non-handed two knuckle hinge according to the present invention.

Referring to FIG. 2, another embodiment of the invention is shown. The hinge comprises a first hinge leaf 12 and second hinge leaf 16', and associated first and second hinge knuckles, 14 and 18' respectively. A pintle 20' having a pintle head 26' similar to that described in connection with FIG. 1 is also provided which extends through the axially aligned bores of the first and second hinge knuckles.

As in the case of the FIG. 1 embodiment, the first hinge knuckle 14 has a first load bearing bushing 28 having a flanged end 32 facing the second hinge knuckle 18', and a second load bearing bushing 40 facing the pintle head 26'. The second hinge knuckle 18' is counterbored at its end facing the first hinge knuckle 14 to receive a washer 30. Both the washer 30 and bushing 28 are made of a low friction material, e.g., plastic, for increase service life. Likewise, the other end of the first hinge knuckle 14 is counterbored to receive the second bushing 40, which has a flange portion 42 facing the pintle head 26'. The second bushing 40, is also formed of a low friction material to decrease the spring torque necessary to open and close the door and to increase the life expectancy of the hinge. As in the case of the FIG. 1 embodiment, the bushings 28 and 40 also operate as a pair of spaced lateral bearings in the pivoting hinge knuckle 14 to support the pintle 20'.

In this embodiment, however, a portion of the inserting end 21' of the pintle is provided with threads 25, and the interior of the bore of the second hinge knuckle 18 has a cooperating threaded metal bushing 27 for receiving the threads 25 of the pintle. In addition, the second hinge knuckle is drilled and tapped to receive a set screw 24' to secure the pintle 20' and bushing 27 from inadvertent rotation once assembled. This form of the invention is assembled by inserting the pintle 20 into the bore of the first hinge knuckle 14 and thereafter into the bore of the second hinge knuckle 18', threading the pintle 20' into the flanged bushing 27 until the knuckles are pressed together, and then unscrewing the pintle 20' a small fraction of a turn and tightening the set screw to hold the pintle in the position of adjustment.

In operation in a left-handed door installation, the hinge leaf attached to the jamb will always carry the upper hinge knuckle; for example, where the second hinge leaf 16 or 16' is attached to a jamb and the first hinge leaf 12 is attached to a door in such a manner that the first hinge knuckle 14 is positioned above the second hinge knuckle 18'. Thus, the second hinge knuckle 18' and the pintle 20 or 20' supports the first hinge knuckle 14 and leaf 12, with the bushing 28 and washer 30 forming a thrust bearing. Alternatively, if the hinge is inverted but still used in a left-handed door installation, the hinge leaf 12 with the first hinge knuckle 14 is attached to the jamb, and the door is hung from the second hinge leaf 16 or 16'. Thus the first hinge knuckle 14, which will now be the lower knuckle, supports the second hinge knuckle 18' and leaf 16 or 16', and the bushing 28 and washer 30 form a vertical thrust bearing in the opposite direction.

For use in a right-handed door installation, the hinge leaf attached to the jamb will always carry the lower hinge knuckle. For example, if the hinge leaf 16 or 16' with the second hinge knuckle 18' is attached to the door and the other hinge leaf 12 is attached to the jamb in a right-handed installation, the second hinge knuckle 18' would be positioned below the first hinge knuckle 14. The hinge, will not separate, however, because the pintle head 26 or 26' bears against the flange 42 of the bushing 40 to form a vertical thrust bearing and thus support the lower hinge. Alternatively, if the hinge 10 is inverted but still attached in a right-handed configuration, the hinge leaf 16 with the second hinge knuckle 18' would be attached to the jamb with the other hinge leaf 12 attached to the door. Mounted as such, the first hinge knuckle 14, upon which the door is hung, is positioned below the second hinge knuckle 18'. The flange 42 of the bushing 40 and the pintle head 26 or 26' form a vertical thrust bearing in the opposite direction, again to permit the leaf 12 to pivot and prevent separation of the hinge.

Of course the second hinge knuckle 18 or 18' could be attached to the lower portion of the hinge leaf 12, rather than the hinge leaf 16' as shown in FIGS. 1 and 2, with the first hinge knuckle 14 being attached to the upper portion of the hinge leaf 16', rather than the hinge leaf 12. With this type of hinge construction, the washer 30 and the flange 32 of the bushing 28 would form a vertical thrust bearing in right-handed door installations, while the flange 42 of the bushing 40 and the pintle head 26 would form a thrust bearing in left-handed door installations.

It will be understood that the above described embodiments are merely exemplary and that those skilled in the art may make many variations and modifications without departing from the spirit and scope of the invention. For example, in place of the set screw 24 and recess 22 (FIG. 1) or the threaded bushing 27 and pintle threads 25 (FIG. 2), other means may be employed to secure the pintle 20 or 20' in the second knuckle 18 or 18'. For example, a cross pin extending through the knuckle 18 or 18' may engage the pintle 20 or 20' by extending through a hole in the pintle arranged perpendicular to and extending through the pintle longitudinal axis. Alternatively, the cross pin could be off center, and engage the pintle in a recess such as that shown in the FIG. 1 embodiment (recess 22). All such modifications and variations are intended to be within the scope of the invention as defined in the following claims.

I claim:

1. A non-handed two knuckle hinge comprising a pair of adjacent hinge leaves, axially aligned hinge knuckles formed respectively on the adjacent edges of said hinge leaves, an axially extending bore in each said knuckle for receiving a pintle, attachment means for the leaves adapted to be used to attach them to a door and jamb, the first hinge leaf adapted to be attached to either of said door or jamb, and the second hinge leaf adapted to be attached to the other of said door or jamb, a pintle extending through the bore of the first hinge knuckle on the first hinge leaf and into the bore of the second hinge knuckle on the second hinge leaf, said pintle having a pintle head of enlarged cross section at the outer end of said first knuckle, about which pintle said first hinge knuckle pivots, and means securing said pintle in said second hinge knuckle; first bearing means between said hinge knuckles for acting as a vertical thrust bearing when a door is attached to the first hinge leaf and the second hinge leaf is attached to a jamb in one of a right-handed or left-handed installation, and second bearing means between said pintle head and said first hinge knuckle for acting as a vertical thrust bearing when a door is attached to the second hinge leaf and the first hinge leaf is attached to a jamb in the other of a right-handed or left-handed installation, whereby said hinge may be used interchangeably in left-handed and right-handed door installations and inverted in either type of installation without affecting the operation of the hinge.

2. A hinge according to claim 1, wherein said second bearing means is contained in the bore of said first hinge knuckle.

3. A hinge according to claim 1, wherein said means securing said pintle in said second hinge knuckle comprises an annular groove in said pintle arranged to be disposed in said second hinge knuckle and a set screw in said second hinge knuckle for engaging said pintle at said groove to secure said pintle in said second hinge knuckle.

4. A hinge according to claim 1, wherein said pintle is provided with threads, and cooperating threads are provided in the bore of said second hinge knuckle for engaging said threads of said pintle.

5. A hinge according to claim 4, comprising a threaded bushing in the bore of said second hinge knuckle, wherein the threads of said threaded bushing comprise said cooperating threads, and further comprising locking means for inhibiting rotation of said pintle in said bushing.

6. A hinge according to claim 4, comprising a set screw in said second hinge knuckle for engaging said pintle.

7. A hinge according to claim 1, further comprising means for retaining said pintle in said first hinge knuckle.

8. A hinge according to claim 7, wherein said retaining means comprises an annular groove in said pintle and a retaining ring in said groove.

9. A hinge according to claim 1, wherein the bore of said first hinge knuckle is formed with a transverse annular shoulder portion therein, said pintle head is recessed in the bore of said first hinge knuckle, and said transverse annular shoulder portion forms a portion of said second bearing means for said pintle head.

10. A hinge according to claim 9, wherein said first bearing means includes a first anti-friction bushing disposed about said pintle in said first hinge knuckle, said bushing facing the second hinge knuckle and adapted to provide a lateral bearing surface for said pintle.

11. A hinge according to claim 9, wherein said second bearing means includes an anti-friction bushing disposed about said pintle in said first hinge knuckle and engaging said pintle head, wherein said bushing is adapted to provide a lateral bearing surface for said pintle.

12. A hinge according to claim 10, wherein said second bearing means includes a second anti-friction bushing disposed about said pintle in said first hinge knuckle, said second bushing engaging said pintle head and adapted to provide a second lateral bearing surface for said hinge.

13. A hinge according to claim 12, wherein said first and second anti-friction bushings have cylindrical body portions forming integral load bearing journals for said pintle.

14. A hinge according to claim 13, further comprising an anti-friction washer in said second hinge knuckle and facing said first bushing to form an anti-friction surface therefor.

15. A hinge according to claim 14, wherein said first hinge knuckle is counterbored at each end thereof to receive said bushings, and said second hinge knuckle is counterbored to receive said washer.

16. A hinge according to claim 12, wherein said first and second bushings each have a flanged portion facing said second hinge knuckle and said pintle head, respectively, and said first hinge knuckle is counterbored at each end thereof to receive said bushings, the counterbore for receiving said second bushing defining said transverse annular shoulder portion for said pintle head.

* * * * *

UNITED STATES PATENT AND TRADEMARK OFFICE

CERTIFICATE OF CORRECTION

PATENT NO. : 4,475,266

DATED : October 9, 1984

INVENTOR(S) : Charles R. Suska

It is certified that error appears in the above-identified patent and that said Letters Patent is hereby corrected as shown below:

Column 4, line 41, "20" should read -- 20' --;

Column 4, line 54, after "knuckle" (both occurrences), insert -- 18 or --;

Column 4, line 63, after "knuckle" insert -- 18 or --;

Column 5, line 1, after "knuckle" insert -- 18 or --;

Column 5, line 4, before "18'" insert -- 18 or --;

Column 5, line 5, delete the comma after "hinge";

Column 5, line 10, after "16" insert -- or 16' --;

Column 5, line 10, after "knuckle" insert -- 18 or --;

Column 5, line 14, after "knuckle" insert -- 18 or --;

Column 5, line 21, after "leaf" insert -- 16 or --;

Column 5, line 23, before "16'" insert -- 16 or --; and

Column 5, line 28, after "26" insert -- or 26' --.

Signed and Sealed this

*Twelfth* Day of *March 1985*

[SEAL]

*Attest:*

DONALD J. QUIGG

*Attesting Officer* *Acting Commissioner of Patents and Trademarks*